US010233004B2

(12) United States Patent
Holford

(10) Patent No.: US 10,233,004 B2
(45) Date of Patent: Mar. 19, 2019

(54) PACKAGE

(71) Applicant: British American Tobacco (Investments) Limited, London (GB)

(72) Inventor: Steven Holford, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 0 days.

(21) Appl. No.: 15/320,969

(22) PCT Filed: Jun. 30, 2015

(86) PCT No.: PCT/GB2015/051920
§ 371 (c)(1),
(2) Date: Dec. 21, 2016

(87) PCT Pub. No.: WO2016/001662
PCT Pub. Date: Jan. 7, 2016

(65) Prior Publication Data

US 2017/0144816 A1 May 25, 2017

(30) Foreign Application Priority Data

Jul. 1, 2014 (GB) ..... 1411708.9

(51) Int. Cl.

| | |
|---|---|
| ***A24F 15/00*** | (2006.01) |
| ***B65D 77/20*** | (2006.01) |
| ***B65D 75/58*** | (2006.01) |
| ***B65D 85/10*** | (2006.01) |

(52) U.S. Cl.
CPC ..... *B65D 77/2024* (2013.01); *A24F 15/00* (2013.01); *B65D 75/5838* (2013.01); *B65D 85/1045* (2013.01); *B65D 2577/205* (2013.01); *B65D 2577/2058* (2013.01)

(58) Field of Classification Search
CPC ..... B65D 77/2024; B65D 2577/2058; B65D 85/1045; A24F 15/00
USPC ..... 206/264, 242
See application file for complete search history.

(56) References Cited

U.S. PATENT DOCUMENTS

| | | | |
|---|---|---|---|
| 4,280,653 | A | 7/1981 | Elias |
| 4,300,676 | A | 11/1981 | Focke |
| 5,524,759 | A | 6/1996 | Herzberg |
| 6,164,444 | A | 12/2000 | Bray |

(Continued)

FOREIGN PATENT DOCUMENTS

| | | | |
|---|---|---|---|
| DE | 9208932 | U1 | 11/1992 |
| DE | 102010015653 | A1 | 11/2010 |

(Continued)

OTHER PUBLICATIONS

International Search Report for corresponding application PCT/GB2015/051918 filed Jun. 30, 2015; dated Aug. 28, 2015.

(Continued)

*Primary Examiner* — Steven A. Reynolds
(74) *Attorney, Agent, or Firm* — Cantor Colburn LLP

(57) ABSTRACT

The invention relates to packaging for tobacco industry products and, particularly but not exclusively, to packages including a label having a tab. A barrier material encloses one or more tobacco industry products and has a region which, in use, forms an aperture over which is positioned the label. The tab at least partially overlies the region.

14 Claims, 6 Drawing Sheets

(56) References Cited

U.S. PATENT DOCUMENTS

| | | | | |
|---|---|---|---|---|
| 6,505,735 | B1 | 1/2003 | Parker | |
| 7,886,900 | B2 * | 2/2011 | Weiss | B65D 85/1045 206/248 |
| 8,128,776 | B2 | 3/2012 | Schuetz et al. | |
| 8,740,052 | B2 | 6/2014 | Drummond | |
| 8,746,490 | B2 | 6/2014 | Huffer et al. | |
| 9,533,821 | B2 * | 1/2017 | Buse | B65B 19/025 |
| 2002/0003143 | A1 * | 1/2002 | Grayer | B65D 77/2056 220/359.2 |
| 2002/0112982 | A1 | 8/2002 | Stagray | |
| 2003/0047470 | A1 | 3/2003 | Parker | |
| 2003/0164314 | A1 | 9/2003 | Bray | |
| 2004/0031706 | A1 | 2/2004 | Stringfield | |
| 2007/0235512 | A1 | 10/2007 | Drummond | |
| 2009/0071101 | A1 | 3/2009 | Bertuzzi | |
| 2010/0155273 | A1 | 6/2010 | Chatelain | |
| 2010/0230303 | A1 | 9/2010 | Buse | |
| 2010/0276311 | A1 | 11/2010 | Biondi | |
| 2011/0147443 | A1 * | 6/2011 | Igo | B65D 75/5838 229/117.31 |
| 2011/0226640 | A1 | 9/2011 | Bertuzzi | |
| 2011/0303567 | A1 | 12/2011 | Bray | |
| 2012/0006823 | A1 | 1/2012 | Bertuzzi | |
| 2012/0241339 | A1 | 9/2012 | Buse | |
| 2013/0319886 | A1 | 12/2013 | Ledermann | |

FOREIGN PATENT DOCUMENTS

| | | | |
|---|---|---|---|
| EP | 2284095 | A1 | 2/2011 |
| GB | 396570 | | 8/1933 |
| GB | 2451180 | A1 | 1/2009 |
| WO | 2010066543 | A1 | 6/2010 |
| WO | 2012095135 | A1 | 7/2012 |
| WO | 2012120273 | A1 | 9/2012 |
| WO | 2013053408 | A1 | 4/2013 |

OTHER PUBLICATIONS

International Search Report for corresponding application PCT/GB2015/051920 filed Jun. 30, 2015; dated Nov. 4, 2015.

Written Opinion of the ISA for corresponding application PCT/GB2015/051918 filed Jun. 30, 2015; dated Aug. 28, 2015.

Written Opinion of the ISA for corresponding application PCT/GB2015/051920 filed Jun. 30, 2015; dated Nov. 4, 2015.

International Preliminary Report on Patentability for corresponding application PCT/CN2015/051920 filed Jun. 30, 2015; dated Jan. 2017.

International Preliminary Report on Patentability for corresponding application PCT/GB2015/051918 filed Jun. 30, 2015; dated Jan. 12, 2017.

* cited by examiner

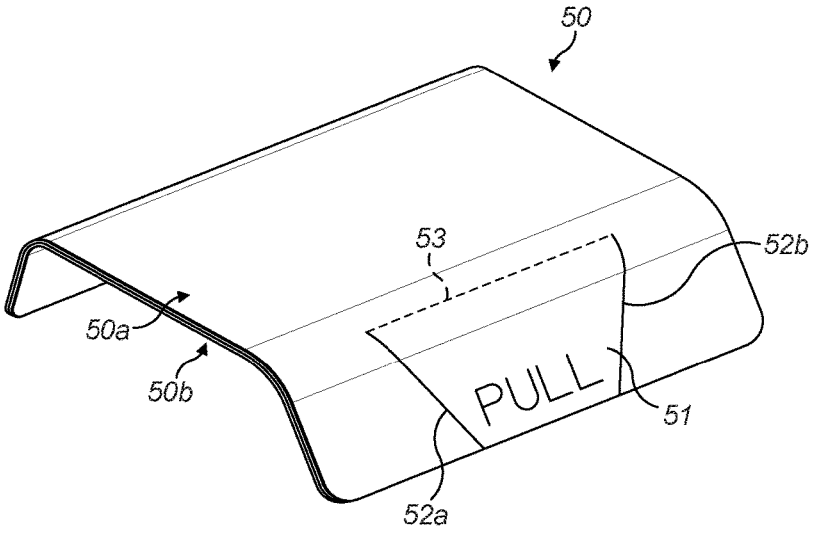
FIG. 3(c)
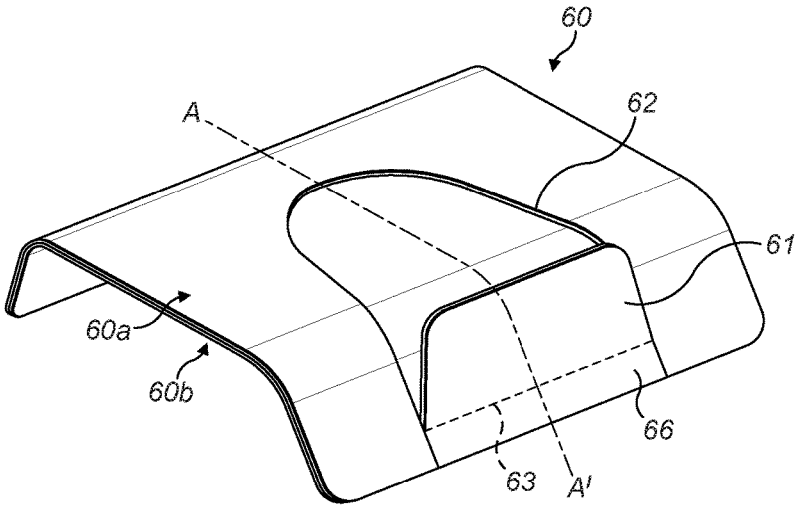
FIG. 3(d)(i)
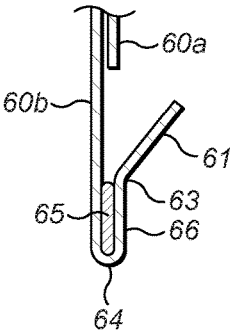
FIG. 3(d)(ii)

PACKAGE

CROSS REFERENCE TO RELATED APPLICATIONS

This application is the U.S. national stage of International Patent Application Number PCT/GB2015/051920 filed on Jun. 30, 2015 which claims priority to United Kingdom Patent Application Number GB1411708.9 filed on Jul. 1, 2014, all of which said applications are herein cross referenced and incorporated by reference in their entirety.

TECHNICAL FIELD

The present invention relates to a package for tobacco industry products and, particularly but not exclusively, to a package comprising a label having a tab. The invention also relates to a method of producing a package.

BACKGROUND

It is known to provide a label for resealing an access opening in a cigarette pack and for the label to have a pull tab for the user to grasp when using the label. The label may be provided with a permanently tacky adhesive on its under surface to releasably adhere the label to the cigarette pack such that it covers the access opening.

SUMMARY

According to embodiments of the invention from a first aspect, there is provided a package comprising a barrier material for enclosing one or more tobacco industry products, the barrier material having a region which, in use, forms an aperture and a label positioned over the region, the label having a tab at least partially overlying the region.

The label can be resealable.

The tab can be connected to the label at a point on the label overlying the region. The tab can be arranged to fully overlie the region. The tab can be arranged to extend parallel to a first face of the package and towards a second face of the package. The tab can be arranged to extend beyond an edge formed by the adjoining first and second faces of the package.

The tab can be connected to the label with a permanent adhesive. The tab can be formed by at least one cut in the label. The at least one cut can extend at each side of the tab in a first direction and on termination has a direction substantially opposite the first direction.

The label can be formed from two or more layers and the tab can be formed from all layer(s) of the label or from a number of layer(s) of the label that is fewer than the total number of layers forming the label.

The layers of the label can be adhered to each other except for the under side of the tab and the surface of the layer over which the tab lies when lying flat against the label, which are free of adhesive.

The tab can be arranged to extend partially or completely into a cut-out portion formed in the label.

A region of the label within the cut-out is free of adhesive. At least a portion of the label is removable from the package and/or a portion of the label is permanently connected to the barrier material.

The label can comprise a permanently tacky adhesive on at least a portion of its under surface.

The package can be enclosed by a container portion and a lid hingedly connected to the container portion and the lid can be arranged to catch and fold the tab upon closure.

According to embodiments of the invention from a second aspect, there is provided a method of producing a package, the method comprising forming a tab from a cut in a label and adhering the label to a barrier material, the label being arranged such that the tab at least partially overlies a region of the barrier material which, in use, forms an aperture over which the label is arranged.

BRIEF DESCRIPTION OF THE DRAWINGS

Examples of the invention will now be described, by way of example only, with reference to the accompanying drawings, in which:

FIG. 3(*b*) is a perspective view of a label for use with packages described herein, the label formed from first and second layers and including a tab formed from a portion of the first layer extending across the width of the label at the lower edge of the label;

FIG. 3(*c*) is a perspective view of a label for use with packages described herein, the label formed from first and second layers and including a tab formed from a portion of the first layer extending partly across the width of the label at the lower edge of the label;

FIG. 3(*d*)(*i*) is a perspective view of a label for use with packages described herein, the label formed from first and second layers and including a tab formed from material of the second layer which is folded back onto itself and into a recess formed by a cut-out in the first layer;

FIG. 3(*d*)(*ii*) is a schematic cross-sectional view of the label of FIG. (3)(*d*)(*i*) taken along line A-A' of FIG. (3)(*d*)(*i*);

FIG. 3(*e*) is a perspective view of a label for use with packages described herein, the label formed from first and second layers and including a tab formed from the first layer extending partially into a recess formed by a cut out in the first layer;

DETAILED DESCRIPTION

The present invention relates to packaging for tobacco industry products. A tobacco industry product refers to any item made in, or sold by the tobacco industry, typically including a) cigarettes, cigarillos, cigars, tobacco for pipes or for roll-your-own cigarettes, (whether based on tobacco, tobacco derivatives, expanded tobacco, reconstituted tobacco or tobacco substitutes); b) non-smoking products incorporating tobacco, tobacco derivatives, expanded tobacco, reconstituted tobacco or tobacco substitutes such as snuff, snus, hard tobacco, and heat-not-burn products; and c) other nicotine-delivery systems such as e-cigarettes, inhalers, lozenges and gum. This list is not intended to be exclusive, but merely illustrates a range of products which are made and sold in the tobacco industry.

The present invention relates, in some examples, to packaging for smoking articles. As used herein, the term "smoking article" includes smokeable products such as cigarettes, cigars and cigarillos whether based on tobacco, tobacco derivatives, expanded tobacco, reconstituted tobacco or tobacco substitutes and also heat-not-burn and e-cigarette or other nicotine delivery products but is not limited thereto. The smoking article may be provided with a filter for the gaseous flow drawn by the smoker.

Figure 1:
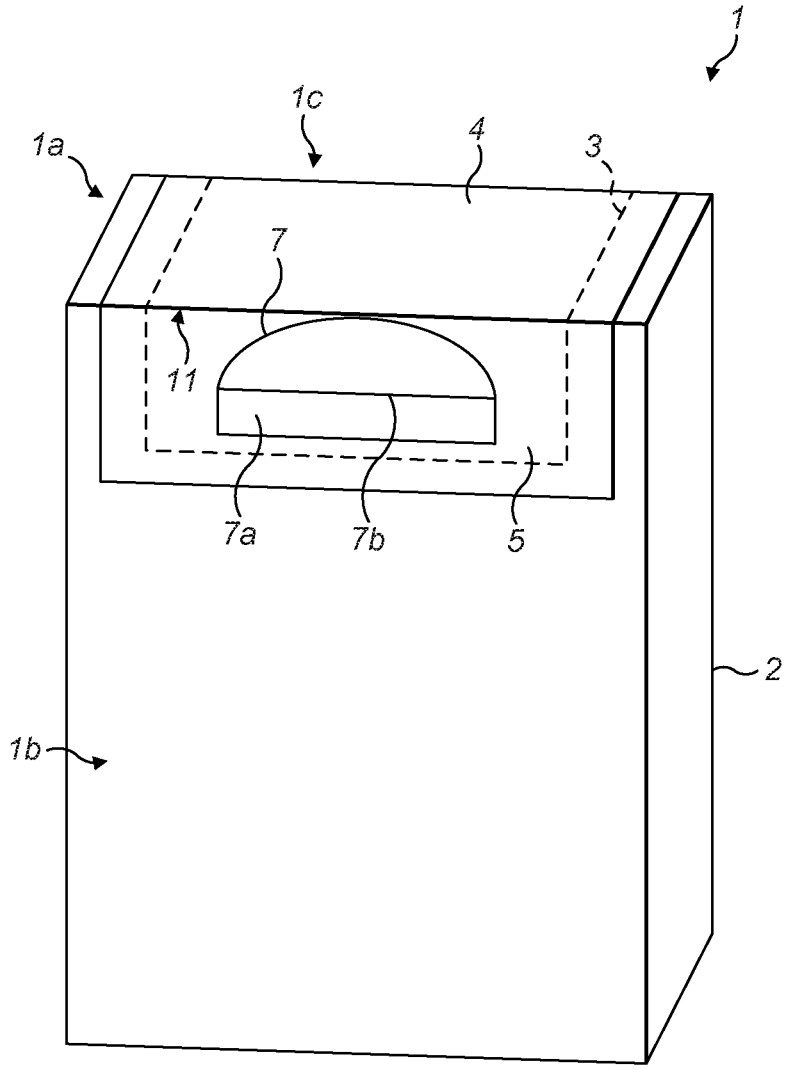
FIG. 1 is a perspective view of a package for smoking articles having a label including a tab which is adhered to the label.

FIG. 1 is a perspective view of a package 1 for tobacco industry products, in the present example for smoking articles. The package 1 includes a barrier material 2 for containing the smoking articles and provides a sealed enclosure around the smoking articles. The barrier material 2 has a line of weakening 3 which defines a region 4 of the pack which, in use, forms an aperture through which smoking articles can be removed.

In the present example, the region 4 extends over a top face 1*a* and a front face 1*b* of the package 1. The region 4 may extend over a single face of the package 1 or over more than one face of the package 1, for instance two, three or more faces of the package 1. The line of weakening 3 is substantially 'U' shaped in the present example, although in alternative examples can form a complete loop.

In the present example, the aperture is resealably closed by a label 5, which is positioned over the region 4. The label 5 includes a permanently tacky adhesive on its under surface which adheres to the barrier material 2. The label 5 is therefore resealable.

The label 5 is provided with a tab 7 which at least partially overlies the region 4 defined by the line of weakening 3, and in the present example completely overlies the region 4. The tab 7 is connected to the label 5 at a point on the label 5 overlying the region 4, although in alternative examples the tab 7 may be connected to the label 5 at a point on the label 5 that does not overlie the region 4.

The tab 7 is arranged so as to allow it to be conveniently grasped by a user. For instance, the tab 7 is arranged to enable the user to grasp the tab 7 to open the label 5 and reveal the aperture in order to remove a smoking article. The periphery of the portion of the tab 7 which is grasped by the user is curved in the present example, forming a substantially semi-circular shape, although other shapes can also be used, such as a substantially triangular, square, elliptical or rectangular shape.

The package 1 is arranged to be provided within an outer container (not shown in FIG. 1), for instance a rigid cardboard container such as a hinge-lid cigarette container. In use, the label 5, including the tab 7, is generally provided beneath the lid of the outer container, and therefore the size of the label 5 and the aperture covered by the label 5 are limited by the size of the lid. Positioning the tab 7 to at least partially overlie the aperture advantageously allows the aperture to be larger than if the tab 7 did not overlie the aperture. If the tab 7 does not at least partially overlie the aperture, the maximum size of the aperture is limited by the need to provide space for the tab 7 between the aperture and the perimeter of the container body against which the lid closes. If the tab 7 is located to at least partially overlie the aperture, the maximum size of the aperture can be increased whilst also allowing the tab 7 to be sufficiently large that it can be easily grasped by the user.

The tab 7 can be provided such that it is not completely covered by the closed lid and is arranged to extend by a given amount from an edge of the closed lid. In these cases, positioning the tab 7 to at least partially overlie the aperture advantageously allows the tab 7 to be larger, and therefore more easily grasped by the user, than if the tab 7 did not overlie the aperture.

In the example of FIG. 1, therefore, positioning the tab 7 to at least partially overlie the aperture advantageously allows the aperture and tab 7 to be increased in size, with the tab 7 still being fully covered by the closed lid of an outer container, and therefore facilitates access to and removal of tobacco products from the package 1.

The label 5 is in the form of a flap having a portion (not shown) extending onto the rear face 1*c* of the package 1 which is permanently adhered to the barrier material 2. The label 5 has permanently tacky adhesive covering the remainder of its under surface which, within the region 4, adheres the label 5 permanently to the barrier material 2 and, on portions of the label 5 which extend outwardly of the region 4, releasably attach the label 5 to the barrier material 2, forming a seal around the region 4. In alternative examples of the invention, the label 5 may have permanent adhesive connecting the label 5 to the region 4 of barrier material 2, rather than permanently tacky adhesive. Also, all or part of the label 5 may be removable from the barrier material 2 altogether, for instance by providing a line of perforations across the label 5 enabling a portion to be removed, or by using only permanently tacky adhesive to adhere the label 5 to the barrier material 2, such that the complete label 5 can be removed.

The tab 7 extends from the portion of the label 5 overlying the front face 1*b* of the package 1, and projects towards the portion of the label 5 overlying the top face 1*a* of the package 1. Alternatively, the tab 7 may extend from the portion of the label 5 overlying any first face of the package and project in any direction, for instance towards any second face of the package 1. For example, the tab 7 may extend from the portion of the label 5 overlying the top face 1*a* of the package 1 and project towards the portion of the label 5 overlying the front face 1*b* of the package 1. The tab 7 may extend from any portion of the label 5 and project towards any other portion of the label 5.

Figure 5:
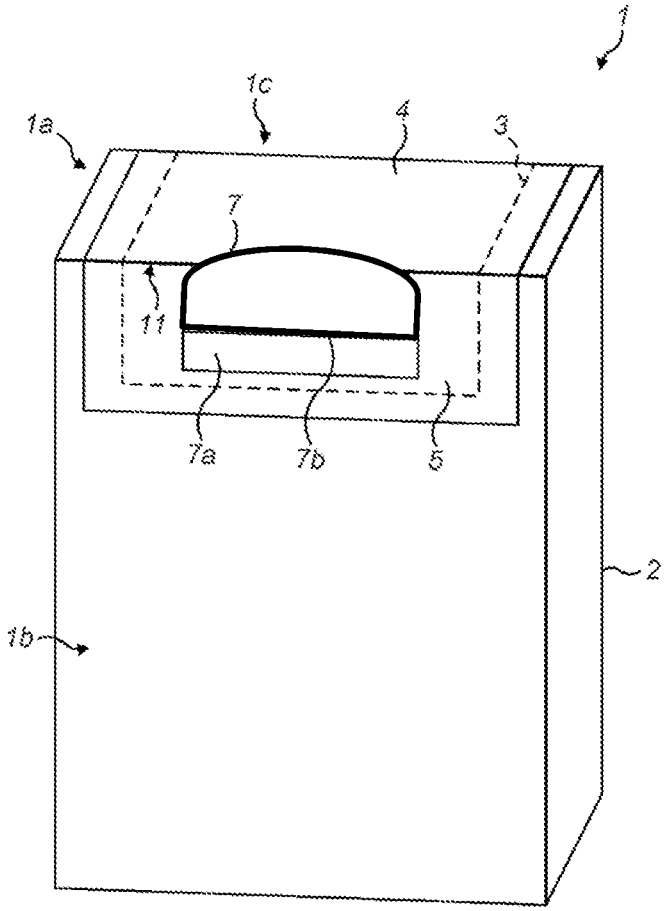
FIG. 5 is a perspective view of a package for smoking articles, the package having a tab extending beyond an edge formed by the adjoining first and second faces of the package.

In the present example, as seen in FIG. 5, the tab 7 extends beyond the edge 11 formed from the adjoining top and front faces 1*a*, 1*b* of the package 1. This enables the tab 7 to be more easily grasped than a tab which does not extend beyond such an edge 11, since a portion of the rear of the tab 7 is exposed allowing the tab 7 to be pulled forwards as it is grasped. Alternatively, the tab 7 may abut or terminate before reaching the edge 11 formed from the adjoining front and top faces 1*b*, 1*a*. The tab 7 may extend beyond, abut, or terminate before the edge formed from any two adjoining first and second faces of the package 1 on which the label 5 is located.

In the present example, the tab 7 is initially independent of the label 5 and is adhered to the label 5 with a permanent adhesive. The permanent adhesive is applied to a lower portion 7*a* of the undersurface of the tab 7 and extends along the length of the tab 7. Alternatively, the tab 7 may be connected to the label 5 by permanent adhesive applied to other portion(s) of the undersurface of the tab 7. The exterior surface of the tab 7 and/or label 5 may have a printed logo or writing. A score line 7*b* can optionally be applied across the tab 7 to separate the lower portion 7*a* where permanent adhesive connects the tab 7 to the label 5 from the remainder of the tab 7, which is grasped by the user. This can facilitate the user in pulling the tab 7 forwards when grasping the tab 7.

The barrier material 2, label 5 and/or tab 7 may be made from a material such as a metallised plastic or a plastics/metal foil laminate. The barrier material 2, label 5 and tab 7 may be made from the same material or different materials. The barrier material 2, label 5 and/or tab 7 may comprise a material which is transparent or opaque. In the present example, the barrier material 2, label 5 and tab 7 are each formed from single layers of material. Alternatively, the barrier material 2, label 5 and/or tab 7 may be formed from two or more layers of material.

Figure 2:
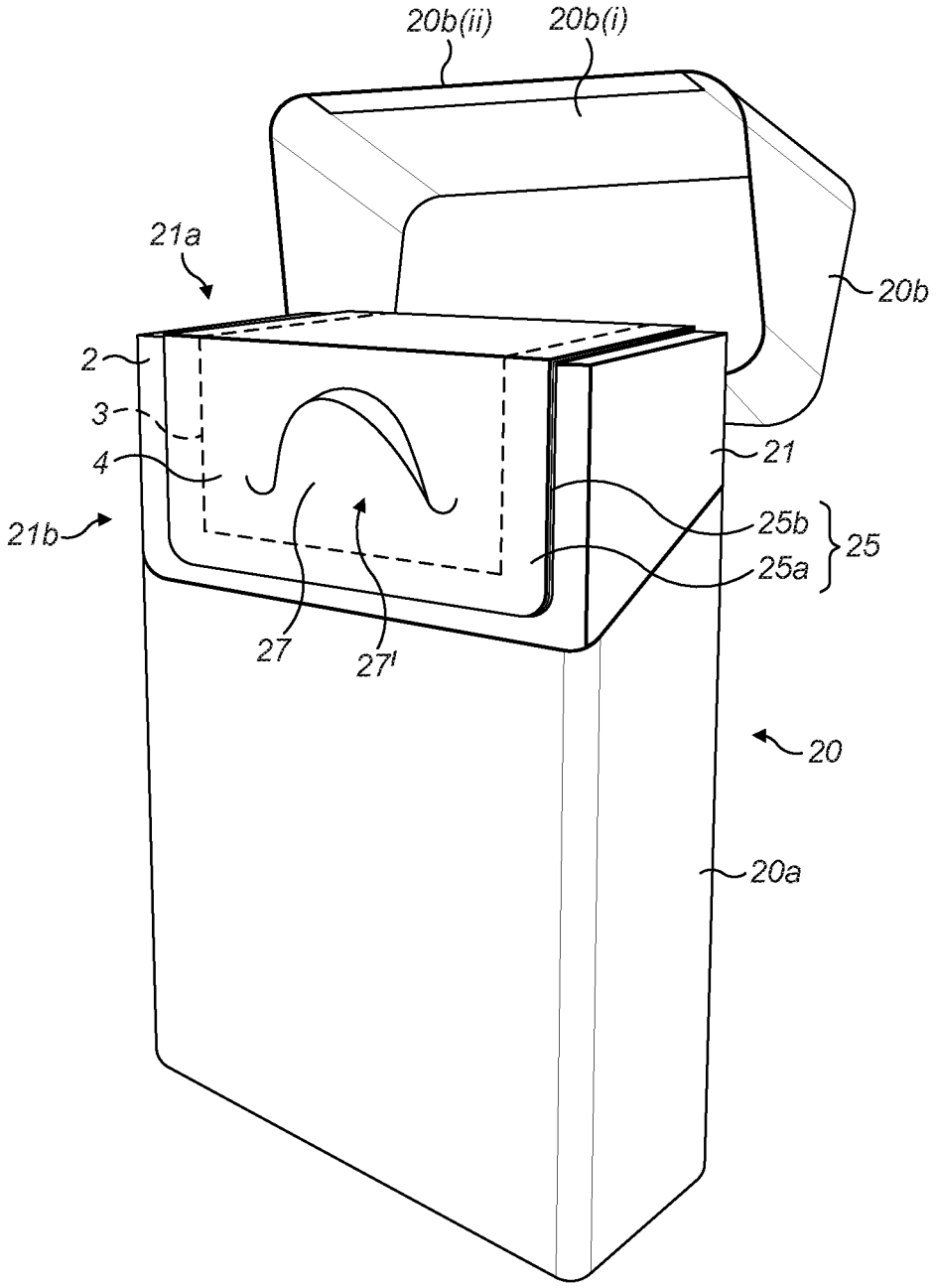
FIG. 2 is a perspective view of a container enclosing a package for smoking articles, the package having a label formed from multiple layers and including a tab formed from at least one of the layers extending upwardly from a front face of the label.

FIG. 2 is perspective view of a container 20 enclosing a package 21 for smoking articles. The package 21 is disposed within the container 20 which comprises a body 20*a* and a lid 20*b* hingedly connected to the body 20*a*. The container 20 may be formed from a blank, and may be made of card, or of a similar foldable material. The container 20 may be overwrapped with a removable layer, for example cellophane.

The package 21 is generally similar to the package 1 described with reference to FIG. 1, and similar features are identified by the same reference numerals. For instance, the package 21 includes a barrier material 2 which has a line of weakening 3 defining a region 4 of the pack which, in use, forms an aperture through which smoking articles can be removed, in a similar way to the package 1 of FIG. 1.

The aperture is, in the present example, resealably closed by a label 25 which differs from the label 5 of FIG. 1, as set out in more detail below.

The label 25 is provided with a tab 27 completely overlying the region 4 defined by line of weakening 3. The tab 27 is connected to the label 25 in a region 27' and from that region extends upwardly towards the top of the package 21. The label 25 is formed from multiple layers, with the tab 27 formed from at least one of the layers. In the present example, the tab 27 extends upwardly from a portion of the label 25 extending over the front face 21*b* of the package 21. In particular, in the present example, the label 25 is made from first and second layers 25*a*, 25*b*, with the first layer 25*a* on the outer side of the label 25 and the second layer 25*b* on the inner side of the label 25 facing the package 21. The tab 27 is formed from a cut made in the first layer 25*a* only, such that when the tab 27 is pulled forwards, a region of the second layer 25*b* is exposed beneath the tab 27. The first and second layers 25*a*, 25*b* of the label 25 are, in the present example, substantially the same size and shape and arranged with one overlying the other. The first and second layers 25*a*, 25*b* of the label 25 are adhered together by adhesive applied between the layers except for in the region beneath the tab 27, which is free of adhesive enabling the tab 27 to be pulled away from the second layer 25*b*.

In a similar way to the tab 7 of FIG. 1, the tab 27 extends from the portion of the label 25 overlying a front face 21*b* of the package and projects towards the top face 21*a* of the package 21, although alternative configurations are possible, as described with reference to FIG. 1.

Although in the example of FIG. 2 the label 25 is made from first and second layers 25*a*, 25*b* and the tab 27 is formed from a cut made in the first layer 25*a* only, in alternative examples the label 25 can be formed from one or more layers and the cut forming the tab 27 can extend through all of the layers. In this way, when the tab 27 is pulled forwards, a region of the barrier material 2 is exposed beneath the tab 27. The region beneath the tab 27 can be free of the adhesive used to connect the label 25 to the barrier material 2.

In the present example, the tab 27 is formed from a cut in the label 25. The cut, at each side of the tab 27, extends initially in a first direction, in the present example substantially down towards the body 20*a* of the container 20, and on termination is directed substantially in an opposite direction, in the present example upwards towards the top face 21*a* of the package 21. Arranging the cut to have this geometry, as shown in FIG. 2, results in an increased resistance to tearing of the label 25 at the edges of the tab 27 when the tab 27 is grasped and pulled. When the tab 27 is grasped and pulled, a downward force is exerted on the portions of the resealable label 25 adjacent to the tab 27. Arranging the cut, at each side of the tab 27, to extend initially in a first direction and on termination to be directed substantially in an opposite direction, causes the pressure exerted on the aforementioned portions of the resealable label 25 to be dissipated over a larger part of the label 25 and therefore increases the resistance of the label 25 to tearing.

Prior to the user first opening the container 20, the lid 20*b* is closed onto the container body 20*a* and the tab 27 can be folded back over the label 25 and held in position by the front wall 20*b*(*i*) of the lid 20*b*. In this initial state, the undersurface of the tab 27 faces outwards and the tab 27 extends towards the container body 20*a*.

When extracting a smoking article for the first time, the user firstly opens the lid 20*b* to reveal the tab 27. The tab 27 will unfold and project at an angle from the front face 21*b* of the package 21. The tab 27 may project at an angle between 5° and 120° from the front face 21*b* of the package 21. For example, the tab 27 may project at an angle of about 30° from the front face 21*b*.

In order to close container and reseal the package 21 the user simply closes the lid 20*b*. In the present example, the lid 20*b* is arranged to catch and fold the tab 27 back on itself upon closure. As the lid 20*b* closes, it pushes the label 25 towards the barrier material 2, causing the permanently tacky adhesive on the undersurface of the label 25 to re-adhere the label 25 to the barrier material 2. The lower edge 20*b*(*ii*) of front wall 20*b*(*i*) of the lid 20*b* engages with the undersurface of tab 27 and re-folds the tab 27 back to its initial state.

Arranging the lid 20*b* to catch and fold the tab 27 as the lid 20*b* closes advantageously results in the tab 27, upon subsequent openings of the container 20, becoming unfolded and projecting at an angle from the front face 21*b* of the package 21. The tab 27 is therefore displayed clearly to the user each time the container is re-opened and the user can easily grasp the tab 27 to open the label 25.

As with the example of FIG. 1, positioning the tab 27 to at least partially overlie the aperture advantageously allows the aperture and tab 27 to be increased in size, with the tab 27 still being fully covered by the closed lid of an outer container, and therefore facilitates access to and removal of tobacco products from the package 20.

The container may contain two separate enclosures, each containing a charge of smoking articles and each having an independent label having a tab.

Figure 3A:
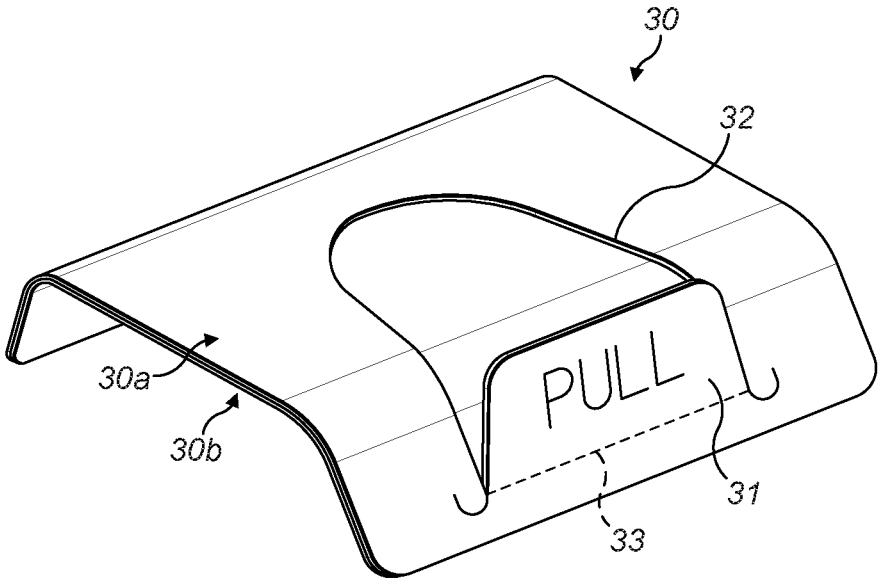
FIG. 3(*a*) is a perspective view of a label for use with packages described herein, the label formed from first and second layers and including a tab formed from the first layer extending partially into a recess formed by a cut out in the first layer.
Figure 3B:
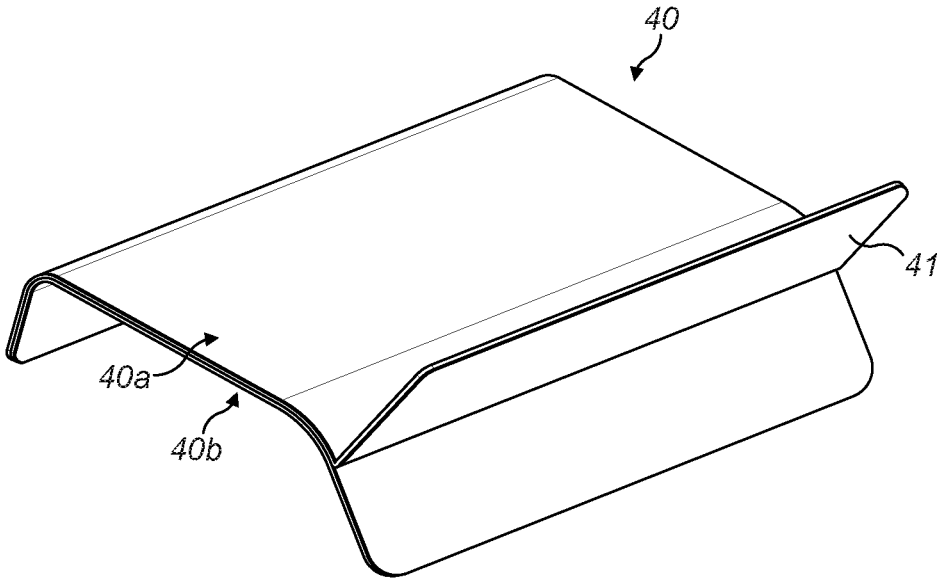
Figure 3E:
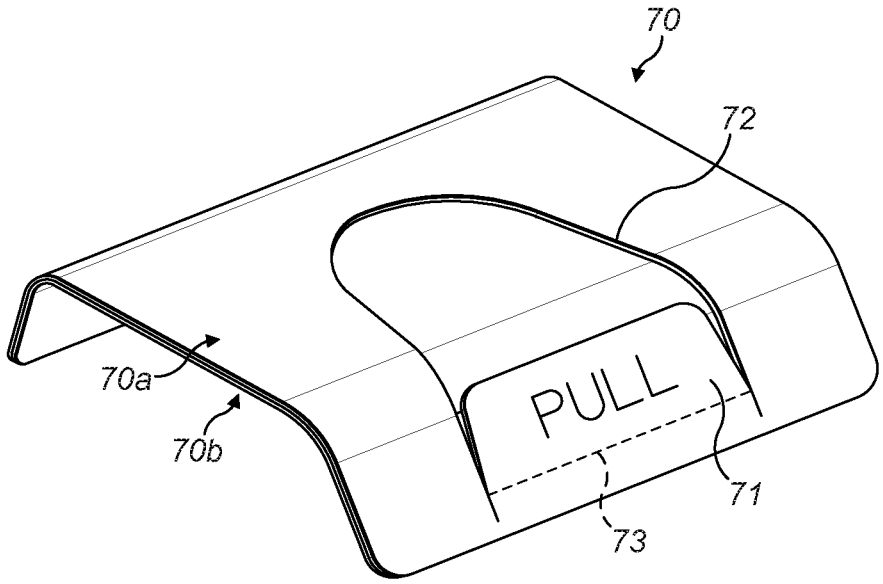

FIG. 3(*a*) is a perspective view a label 30 for use in place of the labels described herein for use with the packages described herein. The label 30 is formed from a first layer 30*a* which is arranged to be on the outer side of the label 30 when applied to a package as described herein, and a second layer 30*b* arranged to be on the inner side of the label 30, facing the package, when applied to a package as described herein. A tab 31 is formed from a portion of the first layer 30*a* and, when lying flat, extends partially into a recess formed by a cut out 32 in the first layer 30*a*. The first and second layers 30*a*, 30*b* of the label 30 of FIG. 3(*a*) are adhered together by adhesive applied across their adjacent surfaces except in the region surrounded by the cut out 32 and the region underlying the tab 31, where no adhesive is applied. A line of weakness 33 such as a score line, partial cut or the like is provided at the edge of the tab 31 where the tab 31 meets the remainder of the label 30, to facilitate lifting the tab 31 up and away from the label 30 when it is grasped. The under surface of the label 30 can be provided with a resealable permanently tacky adhesive for use in resealing the label 30 over the aperture of the package to which it is applied, as described hereinbefore.

Forming the tab 31 such that it extends partially and not completely into a recess formed in the label 30 has the advantage that the tab 31 is easier to grasp by users, who can slide a finger along the back face of the recess and then behind the tab 31, enabling the tab 31 to be lifted.

The label 30 can be used to resealably close packages comprising a barrier material having a region defined by a line of weakening which, in use, forms an aperture through which smoking articles can be removed, such as packages described in the above examples. The label 30 is arranged such that the tab 31 at least partially overlies the region of such packages. The tab 31 is connected to the label 30 at a position on the label 30 which, in use, would overlie the region 4.

In the present example, the tab 31 is formed from a cut in the label 30. The cut, at each side of the tab 31, extends initially in a first direction, in the present example substantially downwards towards a lower edge of the label, and on termination is directed substantially in an opposite direction, in the present example upwards towards a top edge of the label 30. As described with reference to FIG. 2, arranging the cut to have this geometry, as shown in FIG. 3(*a*), results in an increased resistance to tearing of the label 30 at the edges of the tab 31 when the tab 31 is grasped and pulled.

Although in the example of FIG. 3(*a*) the label 30 is made from first and second layers 30*a*, 30*b* and the tab 31 and cut out 32 are formed from at least one cut made in the first layer 30*a* only, in alternative examples the label 30 can be formed from one or more layers and the at least one cut forming the tab 31 and cut out 32 can extend through all of the layers. In this way, when the label is used with a package as described herein, when the tab 31 is pulled forwards, a region of the barrier material 2 is exposed beneath the tab 31. The region beneath the tab 31 and within the cut out 32 can be free of the adhesive used to connect the label 30 to the barrier material 2.

FIG. 3(*b*) is a perspective view a label 40 for use in place of the labels described herein for use with the packages described herein. The label 40 is formed from a first layer 40*a* which is arranged to be on the outer side of the label 40 when applied to a package as described herein, and a second layer 40*b* arranged to be on the inner side of the label 40, facing the package, when applied to a package as described herein. A tab 41 is formed from a portion of the first layer 40*a* arranged at an edge of the label 40 and extending across the width of the label 40.

The first and second layers 40*a*, 40*b* of the label 40 of FIG. 3(*b*) are adhered together by adhesive applied across their adjacent surfaces except in the region underlying the tab 41, where no adhesive is applied enabling the tab 41 to be lifted. A line of weakness such as a score line, partial cut or the like is provided at the edge of the tab 41 where the tab 41 meets the remainder of the label 40, to facilitate lifting the tab 41 up and away from the label 40 when it is grasped. The under surface of the label 40 can be provided with a resealable permanently tacky adhesive for use in resealing the label over the aperture of the package to which it is applied, as described hereinbefore.

The label 40 can be used to resealably close packages comprising a barrier material having a region defined by a line of weakening which, in use, forms an aperture through which smoking articles can be removed, such as packages described in the above examples. The label 40 is arranged such that the tab 41 at least partially overlies the region of such packages. The tab 41 is connected to the label 40 at a position on the label 40 which, in use, would overlie the region 4.

FIG. 3(*c*) is a perspective view a label 50 for use in place of the labels described herein for use with the packages described herein. The label 50 is formed from a first layer 50*a* which is arranged to be on the outer side of the label 50 when applied to a package as described herein, and a second layer 50*b* arranged to be on the inner side of the label 50, facing the package, when applied to a package as described herein. A tab 51 is formed from a portion of the first layer 50*a* arranged at an edge of the label 50 and extending partially across the width of the label 50. In the present example, the tab 51 is substantially trapezoidal in shape, although other shapes can be used. The tab 51 is formed by first and second cuts 52*a*, 52*b* through the thickness of the first layer 50*a* and which do not extend into the second layer 50*b*.

The first and second layers 50*a*, 50*b* of the label 50 of FIG. 3(*c*) are adhered together by adhesive applied across their adjacent surfaces except in the region underlying the tab 51, where no adhesive is applied enabling the tab 51 to be lifted. A line of weakness 53 such as a score line, partial cut or the like is provided at the edge of the tab 51 where the tab 51 meets the remainder of the label 50, to facilitate lifting the tab 51 up and away from the label 50 when it is grasped. The under surface of the label 50 can be provided with a resealable permanently tacky adhesive for use in resealing the label over the aperture of the package to which it is applied, as described hereinbefore.

The label 50 can be used to resealably close packages comprising a barrier material having a region defined by a line of weakening which, in use, forms an aperture through which smoking articles can be removed, such as packages described in the above examples. The label 50 is arranged such that the tab 51 at least partially overlies the region of such packages. The tab 51 is connected to the label 50 at a position on the label 50 which, in use, would overlie the region 4.

FIG. 3(*d*)(*i*) is a perspective view a label 60 for use in place of the labels described herein for use with the packages described herein. The label 60 is formed from a first layer 60*a* which is arranged to be on the outer side of the label 60 when applied to a package as described herein, and a second layer 60*b* arranged to be on the inner side of the label 60, facing the package, when applied to a package as described herein, except for a portion forming the a tab 61. The tab 61 is formed from a portion of the second 60*b*, extending partially across the width of the label 60 which is folded back on itself and into a recess formed by a cut out 62 formed in the first layer 60*a*. In the present example, the tab 61 is substantially trapezoidal in shape, although other shapes can be used.

FIG. 3(*d*)(*ii*) is a schematic cross-sectional view of the label 60 of FIG. (3)(*d*)(*i*) taken along line A-A' of FIG.

(3)(*d*)(*i*). As illustrated, a portion of material extending from the second layer 60*b* of the label 60 is folded along a fold line 64 and adhered using adhesive 65 onto itself in a region 66. A line of weakness 63 such as a score line, partial cut or the like is provided at the edge of the tab 61 where the tab 61 meets the region 66, to facilitate lifting the tab 61 up and away from the label 60 when it is grasped.

The first and second layers 60*a*, 60*b* of the label 60 of FIG. 3(*d*)(*i*) are adhered together by adhesive applied across their adjacent surfaces except in the region surrounded by the cut out 62, and underlying the tab 61, where no adhesive is applied enabling the tab 61 to be lifted. The under surface of the label 60 can be provided with a resealable permanently tacky adhesive for use in resealing the label over the aperture of the package to which it is applied, as described hereinbefore.

The label 60 can be used to resealably close packages comprising a barrier material having a region defined by a line of weakening which, in use, forms an aperture through which smoking articles can be removed, such as packages described in the above examples. The label 60 is arranged such that the tab 61 at least partially overlies the region of such packages. The tab 61 is connected to the label 60 at a position on the label 60 which, in use, would overlie the region 4.

FIG. 3(*e*) is a perspective view of a label 70 for use in place of the labels described herein for use with the packages described herein. The label 70 is formed from a first layer 70*a* which is arranged to be on the outer side of the label 70 when applied to a package as described herein, and a second layer 70*b* arranged to be on the inner side of the label 70, facing the package, when applied to a package as described herein. A tab 71 is formed from a portion of the first layer 70*a* and, when lying flat, extends partially into a recess formed by a cut out 72 in the first layer 70*a*. The first and second layers 70*a*, 70*b* of the label 70 of FIG. 3(*e*) are adhered together by adhesive applied across their adjacent surfaces except in the region surrounded by the cut out 72 and the region underlying the tab 71, where no adhesive is applied. The under surface of the label 70 can be provided with a resealable permanently tacky adhesive for use in resealing the label over the aperture of the package to which it is applied, as described hereinbefore.

A line of weakness 73 such as a score line, partial cut or the like is provided at the edge of the tab 71 where the tab 71 meets the remainder of the label 70, to facilitate lifting the tab 71 up and away from the label 70 when it is grasped.

In the present example, the tab 71 is formed from a cut in the label 70. The cut, at each side of the tab 71, extends substantially downwards into the label 70 and terminates at a position above the lower edge of the label 70. Arranging the cut in this way, as shown in FIG. 3(*e*), reduces the likelihood of the label 70 tearing at the edges of the tab 71 when the tab 71 is grasped and pulled.

The label 70 can be used to resealably close packages comprising a barrier material having a region defined by a line of weakening which, in use, forms an aperture through which smoking articles can be removed, such as packages described in the above examples. The label 70 is arranged such that the tab 71 at least partially overlies the region of such packages. The tab 71 is connected to the label 70 at a position on the label 70 which, in use, would overlie the region 4.

As with the examples of FIGS. 1 and 2, positioning the tabs 31, 41, 51, 61, 71 of the examples of FIGS. 3(*a*) to 3(*e*) on the respective labels such that, in use, they at least partially overlie the region forming an aperture of a package, advantageously allows the aperture and tab to be increased in size, with the tab still being fully covered by the closed lid of an outer container, and therefore facilitates access to and removal of tobacco products from a package.

Figure 4:
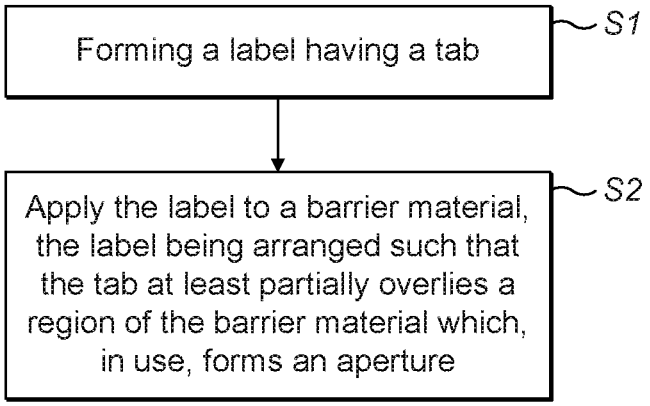
FIG. 4 is a flow diagram illustrating a method for forming packages as described herein.

FIG. 4 is a flow diagram showing a method for forming packages in accordance with examples of the present invention. In a first step S1 a label is formed having a tab. For instance, a multilayered laminate material can be provided and a cut out made in one or more layers to form a label as described herein. In a second step S2 the label is applied to a barrier material, the label being arranged such that the tab at least partially overlies a region of the barrier material which, in use, forms an aperture which is covered by the label.

Although the examples described above disclose resealable labels, alternative examples may have labels that are not resealable. In such examples, at least a portion of the undersurface of the label may be provided with a dry adhesive to adhere the label to a barrier material. After the label has been removed from the barrier material for a first time, the dry adhesive loses its tacky characteristic and the label can not be re-adhered to the barrier material.

In order to address various issues and advance the art, the entirety of this disclosure shows by way of illustration various examples in which the claimed invention(s) may be practiced and provide for superior packaging for tobacco industry products. The advantages and features of the disclosure are of a representative sample of examples only, and are not exhaustive and/or exclusive. They are presented only to assist in understanding and teach the claimed features. It is to be understood that advantages, examples, examples, functions, features, structures, and/or other aspects of the disclosure are not to be considered limitations on the disclosure as defined by the claims or limitations on equivalents to the claims, and that other examples may be utilised and modifications may be made without departing from the scope and/or spirit of the disclosure. Various examples may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A package comprising:

a barrier material for enclosing one or more tobacco industry products, the barrier material having a region which, in use, forms an aperture; and a label positioned over the region, the label having a tab at least partially overlying the region;

wherein the tab extends parallel to a first face of the package and towards a second face of the package; and wherein the tab extends beyond an edge formed by the adjoining first and second faces of the package; and wherein the label is resealable; and wherein the tab is connected to the label at a point on the label fully overlying the region.

2. A package according to claim 1, wherein the tab fully overlies the region.

3. A package according to claim 1, wherein the tab is connected to the label with a permanent adhesive.

4. A package according to claim 1, wherein the tab is formed by at least one cut in the label.

5. A package according to claim 4, wherein the at least one cut extends at each side of the tab in a first direction and on termination has a direction substantially opposite the first direction.

6. A package according to claim 1, wherein the label is formed from two or more layers and the tab is formed from all layer(s) of the label or from a number of layer(s) of the label that is fewer than the total number of layers forming the label.

7. A package according to claim 1, wherein the label is formed from two or more layers and the tab is formed from a number of layer(s) of the label that is fewer than the total number of layers forming the label, and wherein the layers of the label are adhered to each other except for an under side of the tab and a surface of the layer over which the tab lies when lying flat against the label, which are free of adhesive.

8. A package according to claim 1, wherein the tab is arranged to extend partially or completely into a cut-out portion formed in the label.

9. A package according to claim 8, wherein a region of the label within the cut-out is free of adhesive.

10. A package according to claim 1, wherein at least a portion of the label is removable from the package.

11. A package according to claim 1, wherein a portion of the label is permanently connected to the barrier material.

12. A package according to claim 1, wherein the label comprises a permanently tacky adhesive on at least a portion of an under surface.

13. A container for tobacco industry products comprising a body, a lid and containing a package according to claim 1, wherein the package is enclosed by the body and the lid and wherein the lid is arranged to catch and fold the tab upon closure.

14. A method of producing a package, the method comprising:

forming a label having a tab; and adhering the label to a barrier material, the label being arranged such that the tab at least partially overlies a region of the barrier material which, in use, forms an aperture over which the label is arranged, and the tab extends parallel to a first face of the package and towards a second face of the package; and the tab extends beyond an edge formed by the adjoining first and second faces of the package; and wherein the label is resealable; and wherein the tab is connected to the label at a point on the label fully overlying the region.

* * * * *